United States Patent [19]

Ehrenfels et al.

[11] Patent Number: 4,790,765

[45] Date of Patent: Dec. 13, 1988

[54] CONNECTOR SHUNT STRUCTURE

[75] Inventors: Alfred L. Ehrenfels, Chesire; Michael J. D'Amato, North Haven, both of Conn.

[73] Assignee: Hubbell Incorporated, Orange, Conn.

[21] Appl. No.: 104,229

[22] Filed: Oct. 5, 1987

[51] Int. Cl.[4] ..... H01R 4/66

[52] U.S. Cl. ..... 439/96; 439/98; 439/799

[58] Field of Search ..... 439/95–98, 439/799; 174/78

[56] References Cited

U.S. PATENT DOCUMENTS

| | | | |
|---|---|---|---|
| 3,537,060 | 10/1970 | Tordoff | 174/78 X |
| 4,032,205 | 6/1977 | Taj | 174/78 X |
| 4,120,552 | 10/1978 | Winkler et al. | 439/95 |
| 4,408,816 | 6/1983 | Knecht | 339/143 |
| 4,428,639 | 12/1984 | Hillis | 339/143 |
| 4,655,532 | 4/1987 | Hillis et al. | 339/143 |

*Primary Examiner*—Eugene F. Desmond

*Attorney, Agent, or Firm*—Jerry M. Presson; Walter C. Farley

[57] ABSTRACT

A ground shunt structure for an electrical connector which receives a shielded cable includes a electrically conductive spring encircling an exposed end portion of the cable shielding to make physical and electrical contact therewith. An elongated strip of electrically conductive material extends between the shield and a ground contact of the connector, the end adjacent the shield being held by the spring. The spring can be hooked to the strip or can encircle the strip to embrace it.

4 Claims, 3 Drawing Sheets

CONNECTOR SHUNT STRUCTURE

This invention relates to a shunt structure for an electrical connector.

BACKGROUND OF THE INVENTION

Certain types of electrical connectors are constructed to be attachable to shielded cables. While such shielded cables can take a large number of forms, they include at least one, and usually several, electrically conductive insulated wires within a tubular sheath of insulating material which is then surrounded by a layer of electrically conductive material, often in the form of woven bare wires or wires formed in a mesh or spiral configuration. The shielding completely surrounds the insulated wires and usually is surrounded by another layer of insulating material. Additional layers of materials of various kinds can be added for special purposes, but such special purposes are of no consequence to the present invention.

In any connector which is designed to cooperate with such shielded cable, it is important to have some means for connecting the shielding to electrical ground. Normally, one of the contact members of the connector is designated as being the ground contact, whether or not this is also the common contact for the electrical circuit, and it is important to connect the shield to this ground contact member so that the shielding can perform its intended function.

Various devices have been constructed for this purpose. Normally, they are an integral part of the connector itself and are removable or disconnectable, once installed, only with great difficulty if at all. It is, however, desirable to be able to connect the cable shield either to another conductor or to the connector contact in such a way that the connection is adaptable to various sizes of cables and is also able to maintain contact with the shield when the apparatus is used under circumstances in which the cable can move relative to the connector. It is also desirable to be able to easily disconnect the grounding connection from the shield for purposes of checking the circuits with the shield ground removed. This has been either inconvenient or not possible in structures of the prior art.

SUMMARY OF THE INVENTION

Accordingly, an object of the invention is to provide a shunt structure which is easily installable to interconnect the ground contact or a ground wire within the connector to the shield surrounding a shielded cable received therein.

A further object is to provide such a shunt structure which is adaptable to various sizes of cables and maintains contact therewith when the cable moves relative to the connector.

A still further object is to provide such a shunt structure which is easily disconnected to allow checking of the associated circuits.

Briefly described, the invention includes a shunt structure for a connector of the type having a plurality of contact members for making contact with mating members of a mating connector. The connector includes means for receiving a cable having a conductive shield and conductors within the shield. The connector also includes housing means for containing the contact members and the cable so that the conductor within the cable can be attached to the contact members within a portion of the shield being exposed within the housing means. The shunt structure includes an electrically conductive spring, preferably a coil spring, which at least partially encircles the exposed portion of the shield and makes physical and electrical contact therewith. An elongated strip of electrically conductive material extends between the exposed portion of the shield and the body, the strip including means at one end for engaging and electrically contacting the spring and the shield, and means at the other end for making electrical contact with the ground contact.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification, and wherein.

DESCRIPTION OF THE PREFERRED EMBODIMENTS

Figure 1:
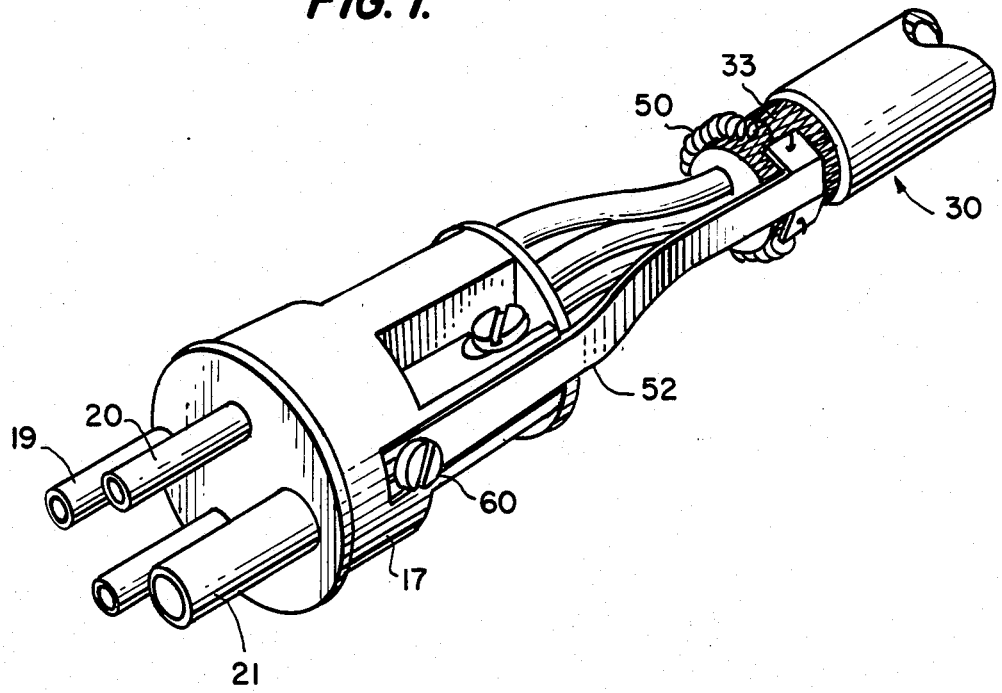
FIG. 1 is a simplified perspective view of some internal portions of a typical connector having a first embodiment of a shunt structure in accordance with the invention attached thereto.
Figure 2:
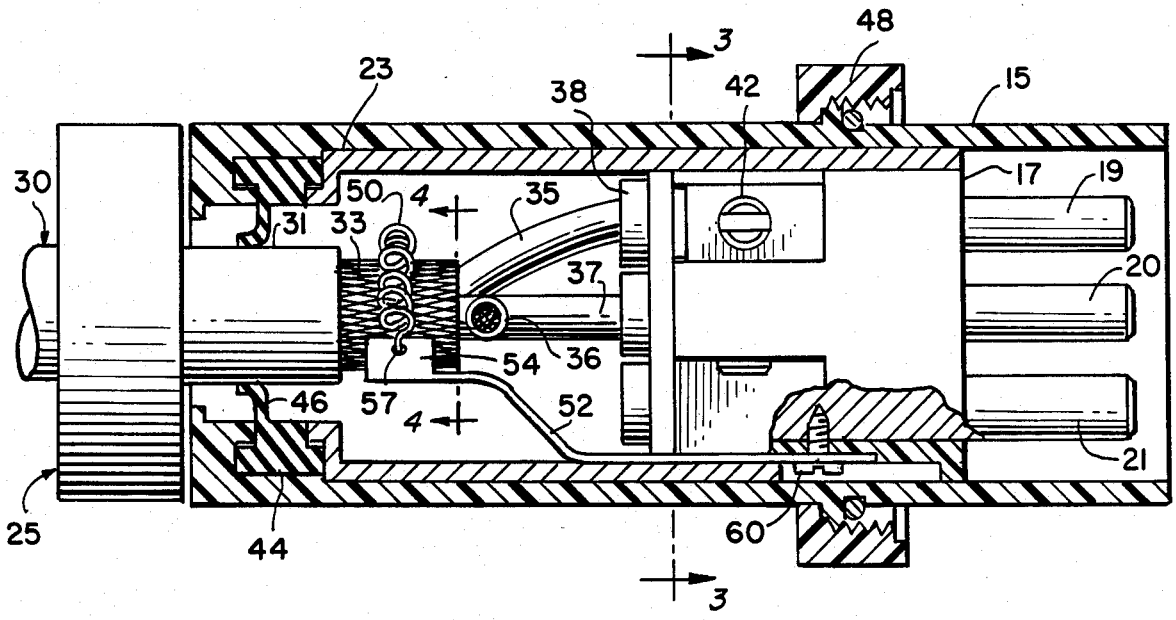
FIG. 2 is a side elevation, in longitudinal section, of a connector having a shunt structure in accordance with FIG. 1 installed therein.

Referring first to FIGS. 1 and 2, the connector in the context of which the shunt structure will be described includes a generally tubular housing 15 which contains a body 17 of electrical insulating material, such as nylon, which carries a plurality of electrical contact members 19, 20 and 21. In the particular connector shown, contact 21 is designated as the ground contact member and is physically larger than the other contact members. Contact members 19–21 are within one open end of housing 15 and are positioned and dimensioned so as to be mateable with a conventional mating connector, not shown.

Also within housing 15 is a generally tubular sleeve 23 which can be made of an electrically conductive material or an insulating material which has been coated with a metallic coating so as to function as an electromagnetic interference (EMI) shield. Sleeve 23 substantially surrounds body 17 and extends rearwardly into the housing.

At the rear end of the housing is a clamp structure indicated generally at 25 for receiving and engaging a cable 30 which extends into the housing. Cable 30 is of the type having an external insulative coating 31, a shield 33 of any conventional type such as woven or braided bare wires, and a plurality of insulated electrical conductors 35–37. The shield can also comprise a metallic tape, or a tape having a metallic surface, helically wrapped around the conductor 35–37 in an overlapping fashion. A separate layer of insulation can also be provided between conductors 35–37 and the shield. The number of conductors is not important to the present invention, three being shown.

Figure 3:
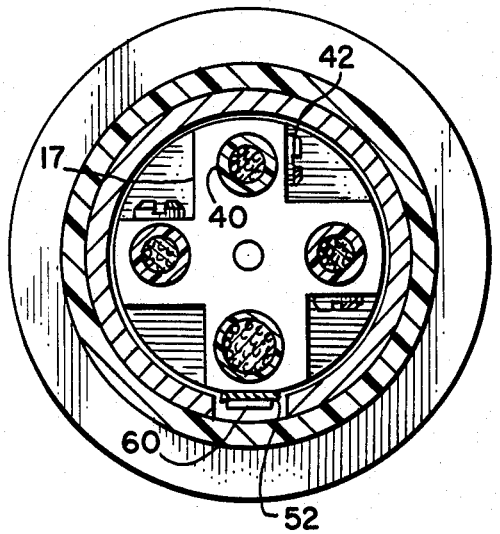
FIG. 3 is a transverse sectional view along line 3—3 of FIG. 2.

At the rear end of body 17 are structures for receiving the stripped ends of wires 35–37 and for electrically engaging and connecting those wires to the rear ends of contact members 19–21 which are embedded in and extend nearly through the body. The wires pass through an end cap 38 which is attached to body 17 by a screw threaded into a hole 39 in body 17 (FIG. 3). The particular form of connection to the wires is of no particular consequence to the invention and any such connecting technique, such as push-in connectors, screw connectors and the like can be employed. In the particular embodiment shown, the connectors each includes a tubular sleeve 40, best seen in FIG. 3, and a threaded fastener 42 which extends into the side of the sleeve for the purpose of engaging the stripped end of its associated wire and firmly physically and electrically pressing the wire against the interior of the sleeve. Each sleeve is fixedly attached to, or formed as an integral part of, one of the contact members. Four connection devices are shown in FIG. 3, at least three of these being employed in the illustrated embodiment. Toward the rear of the housing is a sealing ring 44 which is made of an elastomeric material and has an inwardly extending annular flange 46 with a central opening smaller than the outer diameter of cable 30. When the cable is pushed through the central opening of the sealing ring, the annular flexible flange is forced toward the front end of the connector and the cable protrudes out of the front end so that the wires can conveniently be attached to the connection devices previously described. After connection, the cable is withdrawn and the sealing members assumes the position shown in FIG. 2 and acts as an effective weather seal. The connector also includes an internally threaded flange 48 for connection to the housing of a mating connector.

Figure 4:
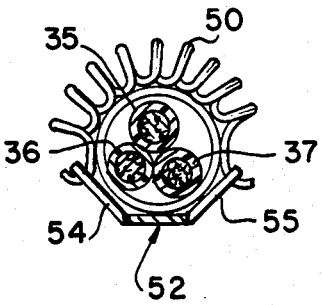
FIG. 4 is a partial sectional view along line 4-4 of FIG. 2.

As thus far described, the shield 33 of the cable is not electrically connected to anything. It is important to have it electrically connected to ground contact 21 or an analogous wire or contact member. For this purpose, the connector includes a shunt structure which comprises a coil spring 50 which, in the embodiment of FIGS. 1–4, partially encircles an end portion of the cable from which the outer insulation 31 has been removed to expose a portion of shield 33. Spring 50 is attached to one end of an electrically conductive strip 52, the end of strip 52 being provided with outwardly extending ears 54 and 55, best seen in FIG. 4, so that the spring and at least part of strip 52 are physically and electrically in contact with shield 33. The length of the spring is selected so that, with the smallest cable expected to be useful with the connector, the spring is under some tension when its ends are attached to ears 54 and 55. This attachment is conveniently accomplished by simply providing holes 57 in ears 54 and 55 and bending the ends of spring 50 so that hooks are formed to pass through the holes. When so assembled, good electrical contact with the shield is obtained but the structure can be easily removed by simply expanding the spring and slipping it off or by unhooking one end of the spring.

Preferably, spring 50 is made from stainless steel or the like and strip 52 is formed from a copper alloy which is a good electrical conductor.

Figure 5:
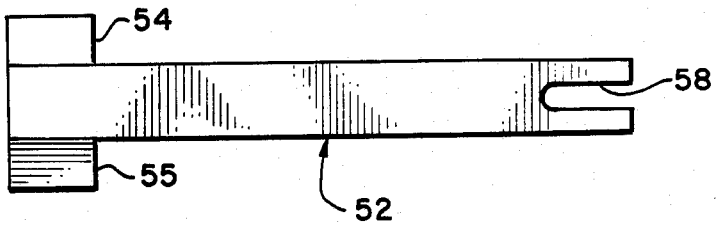
FIG. 5 is a plan view of the strip portion of the shunt structure of FIGS. 1–4 apart from the connector.
Figure 6:
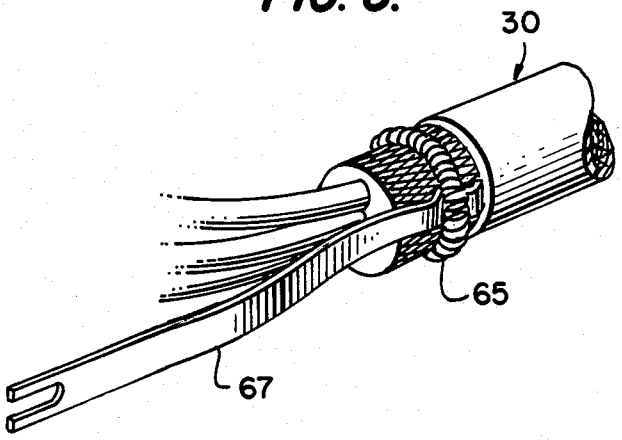
FIG. 6 is a partial perspective view of a second embodiment of a shunt structure in accordance with the invention.
Figure 7:
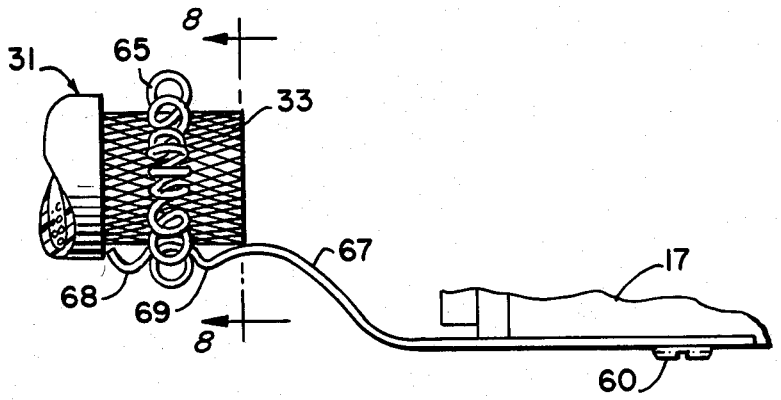
FIG. 7 is a partial side elevation of a shunt structure in accordance with FIG. 6 attached to a connector.

The other end of strip 52 is provided with a longitudinally inwardly extending recess 58, best seen in FIG. 5, strip 52 being dimensioned and bent so that the end having recess 58 is adjacent the side of body 17 which carries contact 21. A machine screw 60 is passed through the opening formed by recess 58 and threadedly engages an opening in an internal portion of contact member 21, forming an electrical and physical contact therewith. The shunt therefore provides a very low resistance connection between shield 33 and contact member 21.

Figure 8:
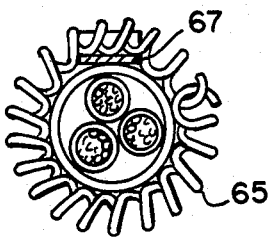
FIG. 8 is a transverse sectional view along line 8—8 of FIG. 7.
Figure 9:
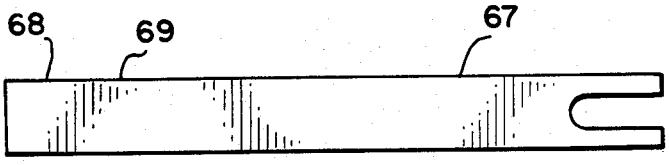
FIG. 9 is a plan view of the strip portion of the shunt structure of FIGS. 6–8.

An alternative embodiment is illustrated in FIGS. 6–9 and will be described in the context of a connector identical to that shown in FIGS. 1–5 which will not be further described. The shunt structure itself includes a coil spring 65 which, as shown in FIG. 8, is hooked to itself to form an essentially endless circular coil spring which surrounds shield 33. Spring 65 engages one end of a strip 67, the other end of which is connected to contact member 21 by a screw 60 as previously described. The end of strip 67 which is engaged by spring 65 is formed with sinuous undulations 68 and 69 so that an outwardly facing concave portion exists therebetween to receive spring 65 and be tightly held against the shielding thereby. Strip 67 is shown apart from the structure in FIG. 9. Again, the strip is made from a suitable copper alloy and is a good conductor, thereby forming a very low resistance connection between shield 33 and contact member 21.

In either of the embodiments it is important to recognize that the coil spring provides a good conductor which is compliant to adapt to surface variations and which performs the dual functions of retaining the shunt and making electrical contact itself with the shield at a large number of contact sites, whether the shield is mesh or tape.

While certain advantageous embodiments have been chosen to illustrate the invention, it will be understood by those skilled in the art that various changes and modifications can be made therein without departing from the scope of the invention as defined in the appended claims.

What is claimed is:

1. A ground shunt structure for a connector of the type having a body of insulating material, a plurality of electrically conductive contact members including a ground contact member carried by said body for making electrical contact with mating contact members of a mating connector, means for receiving an electrical cable having an electrically conductive shield and a plurality of electrical conductors within said shield, and housing means for containing and supporting said body and said means for receiving so that said electrical conductors are connectable to said contact members with a portion of said shield exposed within said housing means, said shunt structure comprising a unitary T-shaped strip of electrically conductive material having an elongated leg and two outwardly extending arms at one end of said leg, said leg being significantly longer than said arms and said arms being bent out of the plane of said leg to approximate chords of a circle, said arms encircling less than 180° of said exposed portion of said shield, the distal ends of said arms having openings therethrough, said leg having means at the other end thereof for making electrical contact with said ground contact member; and an electrically conductive spring encircling the remainder of said exposed portion of said shield and making physical and electrical contact therewith, opposite ends of said spring being hooked through the openings in said distal ends of said arms to hold said arms in good electrical and mechanical contact with said shield.

2. A ground shunt structure for a connector of the type having a body of insulating material, a plurality of electrically conductive contact members including a ground contact member carried by said body for making electrical contact with mating contact members of a mating connector, means for receiving an electrical cable having a conductive shield and a plurality of electrical conductors within said shield, and housing means for containing and supporting said body and said means for receiving so that said electrical conductors are connectable to said contact members with a portion of said shield exposed within said housing means, said shunt structure comprising an electrically conductive coil spring completely encircling said exposed portion of said shield under tension and making physical and electrical contact therewith; and an elongated strip of electrically conductive material extending between said exposed portion of said shield and said body, said strip including means at one end thereof for engaging and electrically contacting said spring and said shield said one end of said strip being held between said spring and said exposed portion, and means at the other end thereof for making electrical contact with said ground contact member, said one end of said strip being bent to form undulations including a concave outwardly facing portion which receives said spring.

3. A structure according to claim 2 wherein said means at said other end for making contact includes means defining a recess extending inwardly from said other end and a threaded fastener passing through said recess and into said ground contact member.

4. A structure according to claim 2 wherein said shield comprises an electrically conductive tape surrounding said conductors, said spring contacting said tape.

* * * * *